US005598920A

United States Patent [19]

Hansen

[11] Patent Number: 5,598,920

[45] Date of Patent: Feb. 4, 1997

[54] CARRIER FOR CARRYING SEVERAL BOTTLES

[75] Inventor: Finn R. Hansen, Honefoss, Norway

[73] Assignee: Rieber & Son A/S, Bergen, Norway

[21] Appl. No.: 509,761

[22] Filed: Aug. 3, 1995

Related U.S. Application Data

[63] Continuation-in-part of PCT/SE94/00095 Feb. 3, 1994.

[51] Int. Cl. [6] ..... B65D 71/00

[52] U.S. Cl. ..... 206/148; 206/434

[58] Field of Search ..... 206/427, 429, 206/434, 435, 139, 145, 147, 148, 149, 151, 152, 153, 158

[56] References Cited

U.S. PATENT DOCUMENTS

| | | | |
|---|---|---|---|
| 4,378,879 | 4/1983 | Killy | 206/427 X |
| 5,135,104 | 8/1992 | Jorba | 206/427 X |

FOREIGN PATENT DOCUMENTS

| | | |
|---|---|---|
| 10048506 | 3/1982 | European Pat. Off. . |
| 10271895 | 6/1988 | European Pat. Off. . |
| 20346693 | 12/1989 | European Pat. Off. . |
| 10428354 | 5/1991 | European Pat. Off. . |

*Primary Examiner*—Jacob K. Ackun
*Attorney, Agent, or Firm*—Davis and Bujold

[57] ABSTRACT

A carrier (10; 10') for a series of bottles (2) having an upwardly conically converging neck (3) and an upper end (7) showing an outer thread for a screw cap (8), or a capsule fastened to an upper bottle collar. The carrier comprises initially a substantially flat sheet (1; 1') made of corrugated cardboard having five longitudinal sections, namely a central section (11; 11'), to the longitudinal edges of which connect two intermediate sections (12; 12' and 13; 13'), to which latter in their turn connect two outer sections (14; 14' and 15; 15'). The sections are separated from each other by grooves (17) and have openings (20; 20'; 21; 21', 22; 22'), which will be aligned, when the sheet is folded to a closed form of profile, an which openings are designed to be penetrated by the neck (3) and the cap (8) of the bottles (2). According to the invention, said sheet and said carrier, respectively, have in the central section (11; 11') foldable flaps (27; 27'; 27") and in the intermediate sections (12; 12'; 13; 13') support flaps (24; 24'; 24"). The flaps are pressed against the cap (8) of the bottles (2) or against any flange (4) or an outer section (14; 14') and the neck (3) to counteract relative movements between the bottles and the carrier respectively for mutual coordination of the latter. The support flaps and lock the flaps in the position of use.

20 Claims, 9 Drawing Sheets

CARRIER FOR CARRYING SEVERAL BOTTLES

FIELD OF THE INVENTION

The present invention is a continuation-in-part of U.S. patent application as designated in PCT/SE94/00095 filed Feb. 3, 1994. The present invention relates to a carrier designed for a series of bottles and is set forth in detail herebelow.

BACKGROUND OF THE INVENTION

Such a carrier is already known through Norwegian patent no. 166 852. Also, it functions very satisfactorily within certain frameworks and for certain types of bottles.

However, it is true that certain types of bottles and caps, particularly some capsules and screw caps, often wear the carrier substantially, particularly if the bottles are fairly heavy and possibly are subjected to protracted and/or frequent movement, e.g. oscillating movement during a lengthy carry while walking or even running. The relatively thin and sharp edges of the capsule, which carries the weight of the entire bottle, can then cut into or be pressed into the corrugated cardboard material, which surrounds the respective holes, which results in an even larger oscillating movement of the bottle, which movement, in turn, increases the wear and tear even faster. The rounded lower edge of a screw cap may instead, like a wedge, penetrate into and finally through the upper hole of the carrier. A bottle or several bottles may in this way inadvertently be set free and fall down and be crushed or broken, which of course is unacceptable. At the same time, it is at least primarily undesirable to use a more stable material than corrugated cardboard, e.g. a plastic material, since a plastic material and possibly also a metallic material are materials which lead to waste problems and must be avoided as much as possible. Corrugated cardboard is much less harmful to the environment and can be produced from recovered raw material and is broken down quickly, if it nevertheless ends up in nature, or it can be combusted without resulting in contaminants which are difficult to handle. Another disadvantage may be that a sheet for a carrier is designed essentially for only one type of bottle and one bottle dimension. Also, it may be difficult, or at least be a waste of time, to manually or semi- or fully automatically apply the known carrier onto bottles or vice versa, since at least in certain phases unambiguous and reliably and safety functioning control means are not available. Finally, it may be necessary to oversize the corrugated cardboard to some extent and/or treat it in a certain way in order to stiffen it and obtain a satisfactory carrying capacity and a certain safety margin.

EP-A1-0 048 506 relates to a carrier of the type described above. However, in this known carrier relative movement between the bottles and the carrier may occur, provided the latter is not made with a completely play-free shape-adaptation in relation to the bottles, on which the carrier is to be applied. However, such a play-free shape-adaptation results in disadvantages. Thus, it may be difficult to press the carrier onto the bottles the additional distance which is required to let the flaps reach their locked positions, subsequent to which a smaller returning movement must be possible. It will then be impossible to obtain a stable bond between such a carrier and smaller bottles, whereas larger bottles cannot be handled at all. During relative movement the flaps may easily be displaced, the locking effect be discontinued, and the bottles can inadvertently be disengaged from the carrier, fall down and break. Another risk is that during relative movement the flaps in particular may be damaged, which endangers the function of the entire carrier, and particularly makes it difficult or impossible to use the carrier. Finally, it is of course a substantial drawback that this known carrier is supplied in a glued condition, which obstructs and raises the price of its handling, transport and storage. All kinds of gluing is objectionable provided there are not important reasons for using glue in very special cases, and when other types of machines for applying the carrier must be used several other inconveniences result.

SUMMARY OF THE INVENTION

The object of the present invention is to develop an improved carrier which can be designed and produced in a simple and economic way, which allows more reliable insertion of the bottles, i.e. with an improved, simple and safe control, which also retains the carried objects in a secure play-free manner and which chiefly shows its superiority through its excellent resistance against wear and bursting, guaranteeing improved security when handling goods. Another object is to allow larger tolerances and other measurement and design deviations, which much more than up to now will be compensated for by just one carrier, or a few carriers designed and dimensioned in different ways. Also, the idea of the principal solution will allow the use of the carrier for multiple uses, possibly using new starting materials or material combinations. The carrier will be simple, quick and reliable, particularly with regard to control when it is applied onto bottles or vice versa and it will be possible to advantageously use it not only a manual but also a semi- or fully automatic application without risk of a shutdown or defective assembly.

These objects are attained in accordance with the present invention by designing a carrier of the type described herebelow.

BRIEF DESCRIPTION OF THE DRAWINGS

Additional characterizing features and advantages of the invention are set forth in more detail in the following description, reference being made to the accompanying drawings, which show, in a partly schematic way, a few preferred but not limiting embodiments of the invention. In the drawings.

DESCRIPTION OF THE PREFERRED EMBODIMENTS

Figure 1:
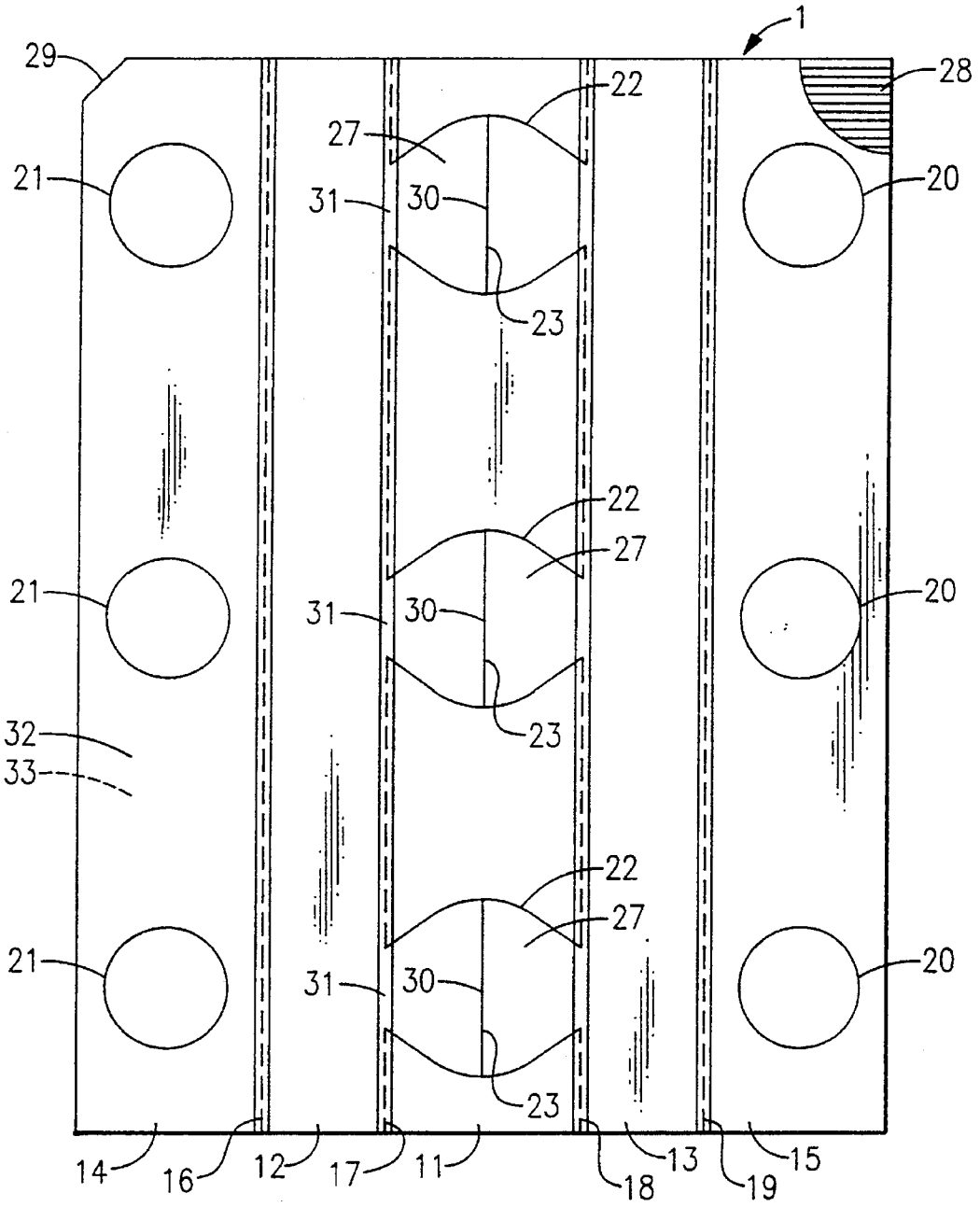
FIG. 1 is a plan view of a finished cut or grooved and/or perforated flat sheet, designed to be formed into a carrier according to the invention.

In FIG. 1 a sheet 1, designed to become a carrier 10, is shown. This sheet 1 preferably comprises a stiff flat corrugated cardboard. However, a plastic material and/or a metallic one, as well as various combinations of laminates thereof can also be used, particularly in case the carrier 10 is to be used repeatedly, which definitely is possible regardless of what type of material is selected.

The sheet 1 typically is rectangular, i.e. somewhat oblong in the same direction as the direction of a series of objects which will be carried. In FIG. 1 three objects are to be handled, preferably bottles 2, particularly so called "magnum"-bottles which commonly are used in the soft drink field, for example. Such bottles 2 (FIG. 3) have an upwardly conically converging neck 3 which, in certain cases, at its top is enclosed by a collar-like flange 4 with a lower side 5 and an upper side 6, from which latter side the neck 3 extends substantially with a cylindric shape 7 with a smaller diameter and an outer thread (not shown), on which a cap 8 is screwed, which has a lower portion 9 facing said flange 4. As an alternative to the thread and the threaded cap 8, a flange 4 and a cap 8 without a thread fastened on the flange 4 can be provided, which feature is generally known in this field.

Figure 3:
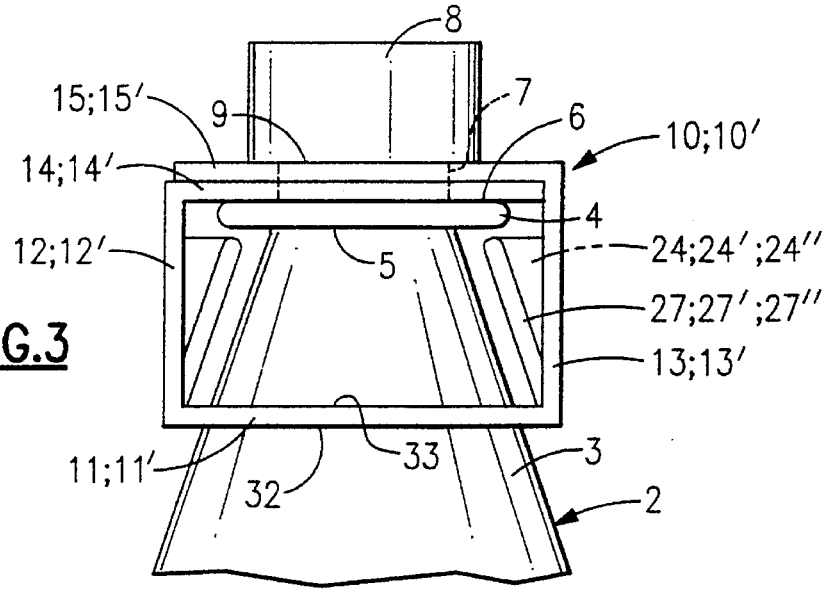
FIG. 3 is a side elevational view of the perforated flat sheet, according to FIGS. 1, 1A, 1B, 2 and 2A, in a folded orientation to form the carrier.

Sheet 1 is subdivided into five longitudinal rectangular sections (FIG. 1), namely one, preferably somewhat wider, central section 11, to which two preferably somewhat less wide intermediate sections 12 and 13 are connected, section 13 of which is slightly wider than section 12, e.g. the thickness of the sheet 1, since section 15 is to be folded on top of section 14, as shown in FIG. 3. The width of central section 11 is decisive of the width of the carrier 10, made according to the following description (see FIG. 3), whereas the width of the intermediate sections 12 and 13 are substantially decisive of the height of the carrier 10. Finally, the sheet 1 laterally comprises first and second outer sections 14 and 15, which have a width which substantially corresponds to the width of the central section 11. A condition for all this is that a carrier 10 which has a rectangular transverse cross-section is to be manufactured, e.g. the carrier 10 shown in FIG. 3.

It is easy to manufacture other cross-sectional shapes, e.g. a trapezoidal shape, by having a wider base positioned either in the central section or the outer sections.

The above-mentioned sections are separated from each other by grooves, perforations, other types of punching or cutting or even solely by an impressed or printed fold indication, for example, which may be sufficient if the sheet 1 per se has a substantially longitudinal structure, e.g. is made of corrugated cardboard. However, it is interesting to observe that in this case a corrugated cardboard structure preferably is to extend with its internal wave configuration or shape perpendicular to the longitudinal direction of the sheet 1. The reason for this will be provided below.

In FIG. 1, dividing areas or grooves or the like are designated by 16, 17, 18 and 19, respectively. In a preferred embodiment, these designations relate to a combination of grooves on the outwardly facing or inwardly facing surface 33 of the sheet 1 and by means of these grooves punch cuts are obtained which extend in a longitudinal direction right through the entire sheet 1, the length of which cuts can be equal to or somewhat longer than the length of the intermediate non-perforated areas. In a practical embodiment, the punch cuts can have a length of about 14 mm and the adjacent non-punched intermediate areas a length of about 12 mm. In this way, it is partly easier to fold the sheet 1 and it is partly easier to guarantee that non substantial bending stress between adjacent sections arises, which sections consequently will retain their straight and flat shape. Also, a carrier 10 which is easy to grip will be produced since the sections open up on the outer side, when the sections are folded at an angle of about 90° into the desired in-use shape. It may be advantageous to mutually displace (stagger) the punching cuts, e.g. giving the two outer cut lines a different distribution pattern than the two inner cut lines.

The first and second outer sections 14 and 15, respectively, are each provided with three apertures 21 and 20, respectively, arranged in a straight line and with the same mutual distance and extending completely through the sheet 1. Apertures 20 and 21 have substantially the same size and will, when sheet 1 is folded according to FIG. 3, be positioned exactly adjacent one above the other. In a preferred embodiment, apertures 21 provided in the lower first section 14 are, when sheet 1 has been folded into its finished shape, somewhat larger than apertures 20 provided in the upper second section 15.

However, central section 11 is not, as is the case with the state of the art, provided with holes conducive to waste of liquid but instead with cuts 22, which extend between the two adjacent grooves or the like 17 and 18. Halfway between the latter the areas enclosed in this way are divided in a mirror-symmetrical way into two flap halves 27 via longitudinal cuts 23, which preferably extend straight through the entire thickness of the sheet 1, possibly excluding a small area or bridge 30 in the middle of it and/or at one or several other places therealong, in which the two halves are connected, the halves in this way are not allowed to be pushed outwardly and thereby detrimentally influence the storage of and the various phases of shaping of the carrier 10, e.g. when it is folded, which may result in surface tension which bends the halves outwardly. Thus, central area or the like 30 constitutes a bridge which prevents this and yet, when the top of the bottle 2 is inserted, will easily break apart and allow the required folding inwardly of said halves.

Cuts 22, which laterally define flaps 27, can follow various patterns, e.g. a parabola-like pattern according to FIG. 1. Cut 23 or a pair of cuts 23 end with its (their) mutually opposite ends in the top of the parabola or in a trapezoidal or triangular or, according to a second embodiment shown in FIG. 2, straight cuts 22' which are perpendicular to the longitudinal cut or cuts 23'. The base or fold lines 31 of flaps 27 obtained in this way coincide with groove 17 and 18, respectively. Particularly in case this base line 31 is comparatively short and it is advisable not to weaken it with perforations. This is true, for example, for the design according to FIG. 1. According to FIG. 2, the base lines 31' and 31" are substantially longer and in this case perforations can be used, but it is also possible to omit them.

Since sheet 1 suitably is provided with grooves solely on the inwardly facing surface 33, which is the inuse non visible rear side in FIG. 1, whereas the outwardly facing visible surface is designated as 32, it probably is important to unambiguously mark the sides of sheet 1, which can be done by one cut off corner 29 at one end of first lower section 14, for example, whereas at the same end of the sheet 1 the corresponding corner of second outer section 15 can be provided with an indication area 28 on the outwardly facing surface and/or the inwardly facing surface. Thus, cut off corner 29 is an optical as well as a physical indication for personnel operating a machine designed to produce and/or stack and/or fold sheets as well as for sensing and/or control devices of such a machine. Area 28 may instead on the outwardly facing surface be an optical indicator, for example, possibly only for the wave direction of the corrugated cardboard or for a glue-free area on the inwardly or outwardly facing surface serving as a tear indication for a disassembly of the carrier 10. If the area is a glue area, then the upper side of first outer section 14 and the lower side of second outer section 15 suitably are provided with a self-acting glue coating or pressure sensitive glue, which allows sections 14 and 15 to adhere to one another but not to other surfaces which lack the self-acting glue. However, it is important to understand that no gluing or any other type of fastening together of sections 14 and 15, and consequently no permanent or temporary attachment of folded sheet 1 to a carrying device in any way is necessary but is an option to consider depending on a number of factors, e.g. suitability, desirability, etc.

The flat sheet 1, which has been treated according to the description above, is now folded in order to assume a final shape according to FIG. 3, which is done in a simple and quick way, either manually or by means of a machine, by folding sections 12 and 13 90° about their grooves 17 and 18, subsequent to which, or at the same time as, the first and second outer sections 14 and 15 are folded in the same direction and with the same angle in relation to sections 12 and 13 about their grooves 16 and 19, first outer section 14 however being folded inward initially, allowing second outer section 15 to subsequently be applied on the outwardly facing surface of first outer section 14 in the manner shown in FIG. 3.

Subsequently objects, e.g. bottles 2, the number of which corresponds to the number of apertures 20 and 21 provided in the obtained carrier 10, and the carrier 10 are brought together, the carrier 10 with its flaps 27 being pressed against a top portion of a bottle cap 8, bridge 30 thereby breaking and the flaps 27, separated from each other in this way, being bent about their fold base lines 31 inwardly towards the inwardly facing surface of intermediate sections 12 and 13 against the action of their inherent resilience or internal structural or possible their material elasticity. As is shown in FIG. 3, each pair of flaps 27 forms converging centering guide surfaces in relation to the cap 8 and possibly the bottle parts that follow the cap 8. The cap 8 finally passes the free ends of the flaps 27 and firstly penetrates apertures 21 and finally apertures 20 and will ultimately, with its lower portion 9, be supported on top of second outer section 15 and then usually lock(s) the second outer section 15 against the first outer section 14, since the diameter of the cap 8 is somewhat larger than the diameter of apertures 20, which means that a certain flexible or in another way non-rigid material constriction has to take place in the areas of the second outer section 15 around apertures 20. When the cap 8 has penetrated apertures 20, the expanded material will return to its initial position before this influence, i.e. it will penetrate into the space below cap lower portion 9 and, in this way, lock not only outer sections 14 and 15 against each other, but also the carrier 10 onto the bottles 2 in quite an efficient way. However, the efficiency in this connection is decisively provided by flaps 27. As soon as the cap 8 and flange 4, possibly positioned below the cap 8 respectively, have passed the free edges of flaps 27, which are formed by cuts 23, the described material and/or structural conditioned elasticity will guarantee that the flaps 27 are bent in the opposite direction about their grooves 17 and 18 and the flaps 27 will be stopped by the bottle neck 3 which, also due to its upwardly tapering shape, allows such a return movement. When the flaps 27 abut the neck 3, their free edge will be positioned below either cap lower portion 9 or, if a flange 4 is provided, its lower side 5, which is clearly shown in FIG. 3. Thus, in this position flange 4 is closely supported between the lower side of first outer section 14 and the free end edges of the flaps 27 and cannot be moved further outward or backwards. In case no flange 4 had been provided, then suitably the central section 11 had been made wider in order to let the flaps 27 in the position shown in FIG. 3, extend below or abut against the lower side of section 14 in order to avoid movement between the bottles 2 and the carrier 10.

It is shown in FIG. 3 that the flaps 27 in a very efficient way support the connection between the bottles 2 and the carrier 10, since such a support action takes place in the longitudinal direction of the flaps 27, in which the flaps 27 have the highest strength or power of resistance, which will be even higher if, for corrugated cardboard, the longitudinal direction of the wave is selected perpendicular to the longitudinal extension of the sheet in FIG. 1, namely extends from the base 31 of the flaps 27 towards free edges 23 of the flaps 27. FIG. 3 also shows clearly shows that comparatively large lever or angular forces can be developed between the cap 8 of the bottle 2 and outer sections 15 and 14, particularly if the openings in central section 11, formed by cuts 22, are larger than the cross-section of the bottle 2 present in said openings. However, at least somewhat larger openings may be desirable, e.g. in order to make a carrier 10 having the dimensions fit objects 2 which vary to some extent as to size and/or shape. Since the flaps 27 in an efficient manner receive and counteract particularly diagonal and also vertical movement between bottles 2 and carrier 10, it is possible to nip in the bud arising play and wear and the entire attachment will be extremely stable, actually stable to such an extent that one does not have to rely entirely on the carrying capacity of outer sections 14 and 15 via their apertures 20 and 21. Thus, it is possible to dispense with the special feature that the material around apertures 20 and/or 21 is to penetrate into the space below cap lower portion 9, e.g. in connection with carriers 10 designed for multiple use. However, usually the existence of this feature is preferred. Flaps 27 and, to a certain extent, also apertures 21, which are somewhat larger than apertures 20, contribute to a quick, simple and reliable guidance of the bottle tops into a carrier 10 according to the invention, since these two features result in a centering influence on the bottle top and the carrier 10 in relation to the bottle tops respectively, because it is possible via a machine to move the carrier 10 towards the bottles 2 or vice versa.

Figure 1A:
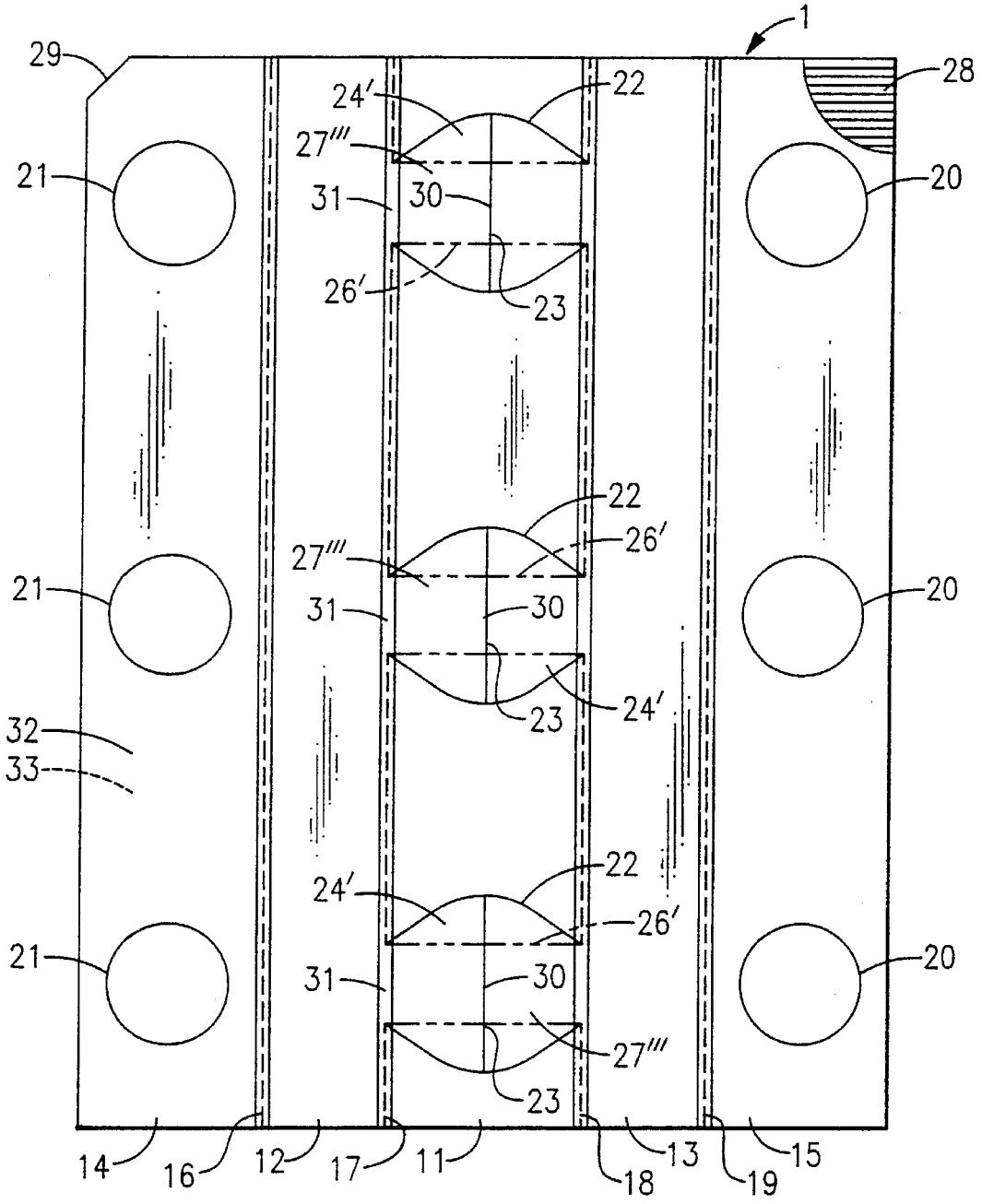
FIG. 1A is a plan view of a finished cut or grooved and/or perforated flat sheet according to a third embodiment of the invention.
Figure 1B:
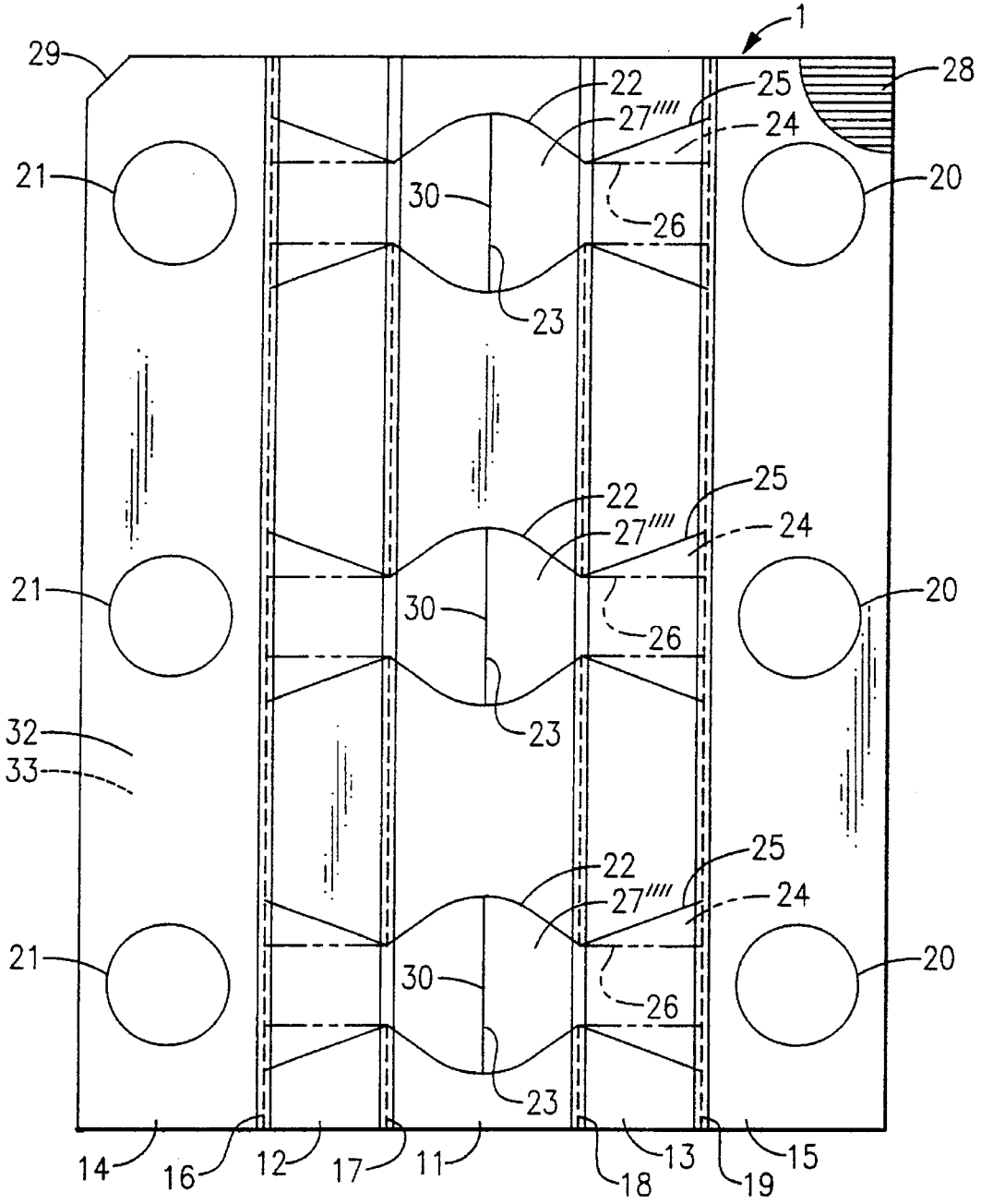
FIG. 1B is a plan view of a finished cut or grooved and/or perforated flat sheet according to a fifth embodiment of the invention.
Figure 2:
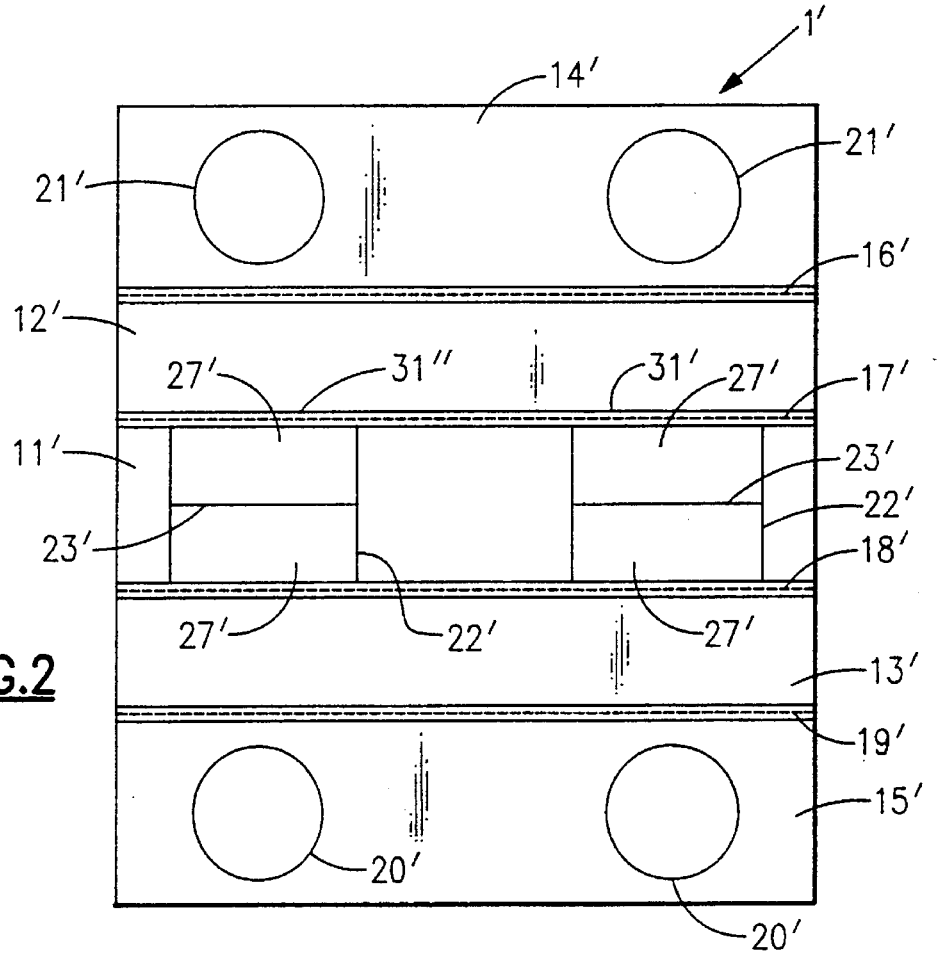
FIG. 2 is a plan view of a finished cut and grooved and/or perforated flat sheet according to a second embodiment of the invention.
Figure 2A:
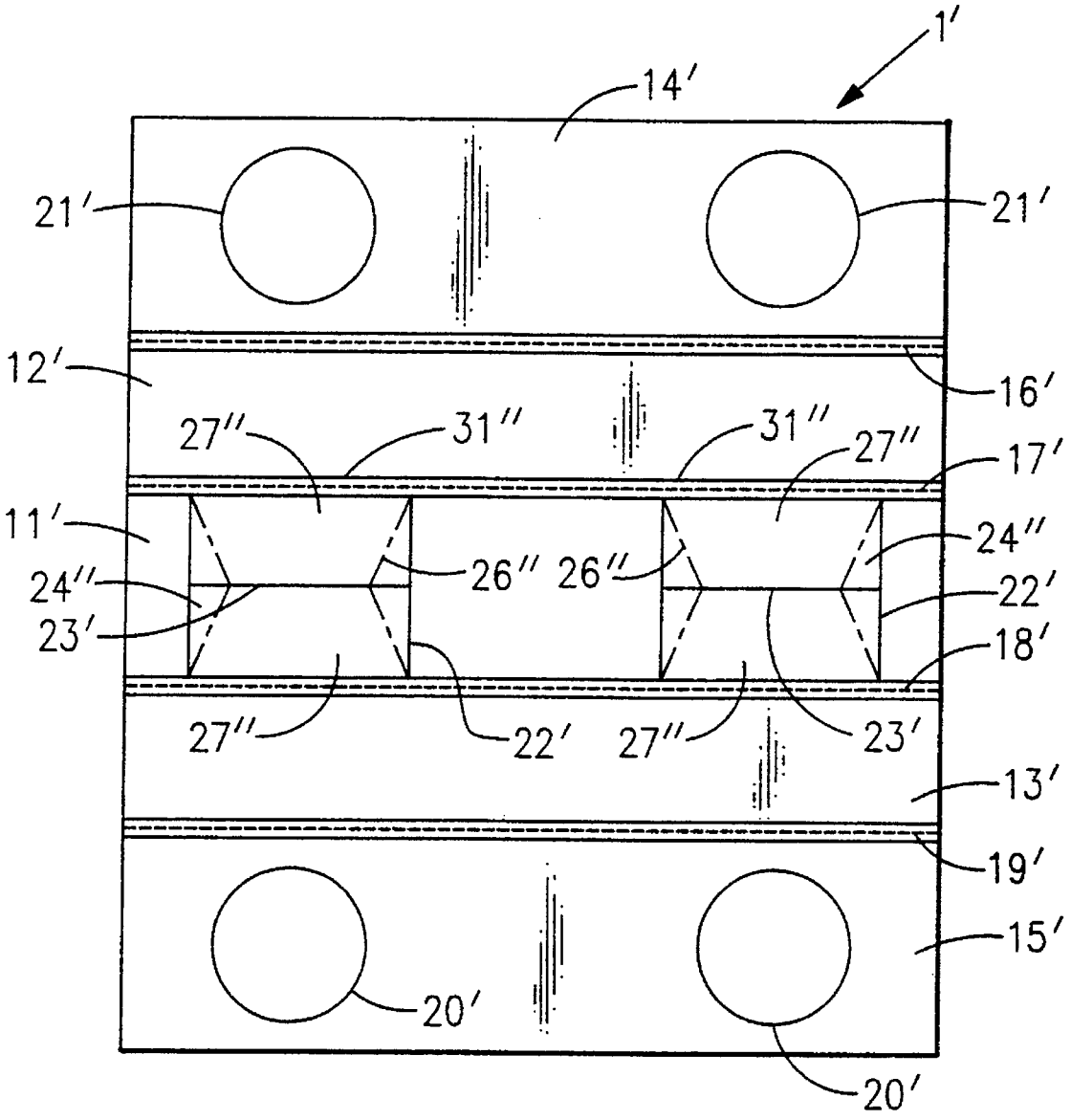
FIG. 2A is a plan view of a finished cut and grooved and/or perforated flat sheet according to a fourth embodiment of the invention.

The above-mentioned guidance effect, as well as the retaining and locking effect, can be improved by obtaining them in accordance with a few modified embodiments respectively, which are shown in FIGS. 1A, 1B and 2A. In third and fourth embodiments, shown in FIGS. 1A and 2A, respectively, lateral portions of flaps 27''' and 27'' have been separated by means of grooves and/or perforations 26' and 26'', respectively, in order to obtain roughly triangular support flaps 24' and 24'', respectively, which are designed to be folded approximately 90° about their base lines or grooves 26' and 26'', the free longitudinal edge in the folded position of the carrier 10' according to FIG. 3 abutting the inwardly facing surfaces of sections 12 and 13, respectively. In this way, the locking position of flaps 27''' and 27'' is guaranteed to an even higher degree and a greater life and locking capacity of such a carrier 10' is also achieved. In this connection, it is an additional advantage to let the longitudinal direction of the wave of corrugated cardboard, for example, to extend perpendicular to cuts 23, because the corrugated cardboard may then be elastically bent outward between a pair of support flaps 24' and 24'', respectively, which may be required, particularly in case the bottles 2 have a flange 4.

It is also possible to use support flaps 24 in sections 12 and 13 as an alternative to parts of support flaps formed from flaps 27'''. A fifth embodiment is shown in FIG. 1B, in which the base lines or grooves are designated with 26 and the hypotenuse cut with 25, whereas the small sides cuts are provided within the grooves and/or perforations of 16 and 19, respectively. Such support flaps 24 have the advantage, compared to flap-bonded support flaps, that they can be folded inward from the intermediate sections 12 and 13 subsequent to the mounting of the carrier 10 on top of a series of bottles 2. In this way it is not necessary to utilize any temporary larger elastic action of the flaps 27''', but they can remain flat in every phase.

A principal and/or extra locking and support action can also be obtained by choosing apertures 21 in first outer section 14 considerably smaller than apertures 20 and, at the same time, enclosing apertures 21 with an annular groove having a diameter, which roughly corresponds to the diameter shown in FIGS. 1 and 2. The annular area between the annular groove and the wall of the hole can be cut in a star-shaped fashion. In such an embodiment, which may be suitable for certain material grades and purposes, said annular area is pressed by means of cap 8 upwards through apertures 20 and is then placed around the circumference of the cap 8 with a certain remaining elastic resilience.

Figure 4:
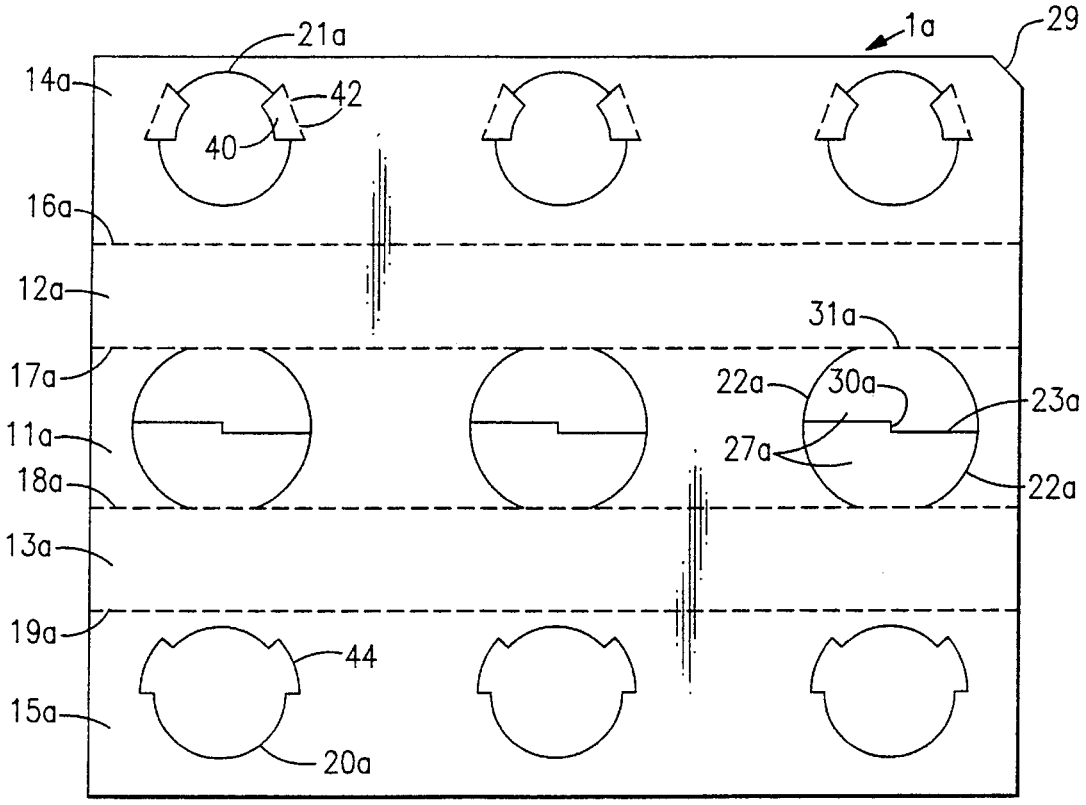
FIG. 4 is a top plan view of a sixth embodiment of the carrier, according to the present invention, in an unfolded orientation.

A sixth embodiment of the invention is shown in FIG. 4. In this embodiment, apertures 20A and 21A are slightly oblong in the longitudinal direction of sheet 1A, with a dimension in this direction approximately equal to the diameter of flange 4. In the transverse direction, the apertures 20A and 21A are slightly narrower than flange 4, preferably 1–4 mm narrower than flange 4. The apertures 21A are provided with locking tabs 40. The tabs 40 are connected by bridges 42 to the first outer section 14A to facilitate folding of the tabs 40 relative to the first outer section 14A. The tabs 40 interlock with notches 44 provided in second outer section 15A adjacent the apertures 20A once cap 8 and flange 4 of bottle 2 push through apertures 21A and 20A and the apertures 21A and 20A are aligned with one another in a manner similar to that described regarding the first embodiment. This interlocking action provides additional support, stability, and rigidity for the carrier 10A.

Longitudinal cuts 23A extend between cuts 22A and define flap halves 27A, as with the first embodiment. Cuts 23A do not comprise a single straight line cut between cuts 22A, but rather have an offset portion 30A located at the center of each cut 23A. Each offset portion 30A of the cuts 23A comprises an uncut bridge, similar to bridge 30 of the first embodiment. The offset portions 30A will easily break apart once the bottle 2 is inserted into the assembled carrier 10A and passes through the aperture provided in central section 11A. This offset allows flaps 27A to be longer than flaps 27 would normally be without the offset, so that carrier 10A can accommodate bottles of different neck lengths.

Figure 5:
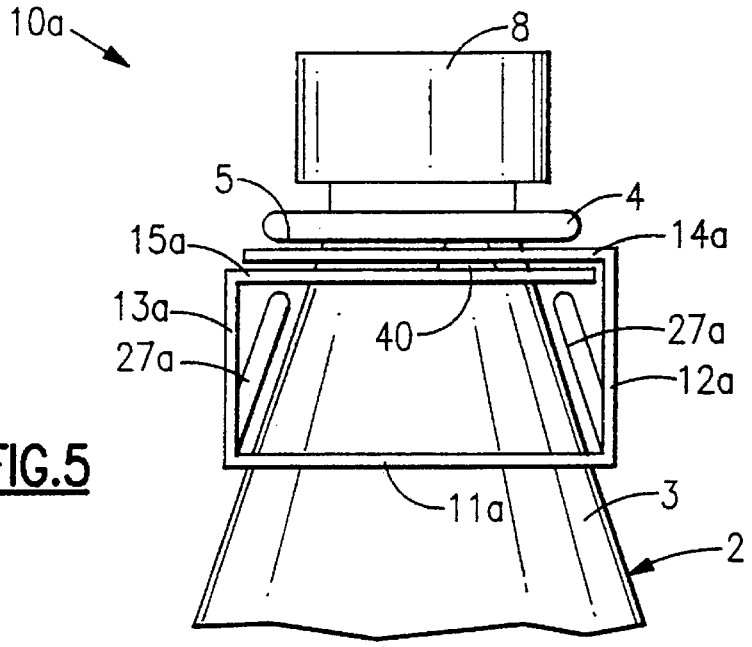
FIG. 5 is a side elevational view of the carrier of FIG. 4 in its folded in-use orientation.

FIG. 5 shows a side elevational view of the sixth embodiment according to FIG. 4, with the carrier 10A shown in its folded in-use configuration connected to a bottle 2. In this embodiment, first outer section 14 and second outer section 15 are supported by flaps 27A engaging under flange 4. Tabs 40, interlocking with notches 44, lock under the lower side 5 of flange 4 in the longitudinal direction of carrier 10A. In particular, one tab 40 is shown, in this Figure, projecting from first outer section 14 through second outer section 15 and locking under lower side 5 of flange 4.

Figure 6:
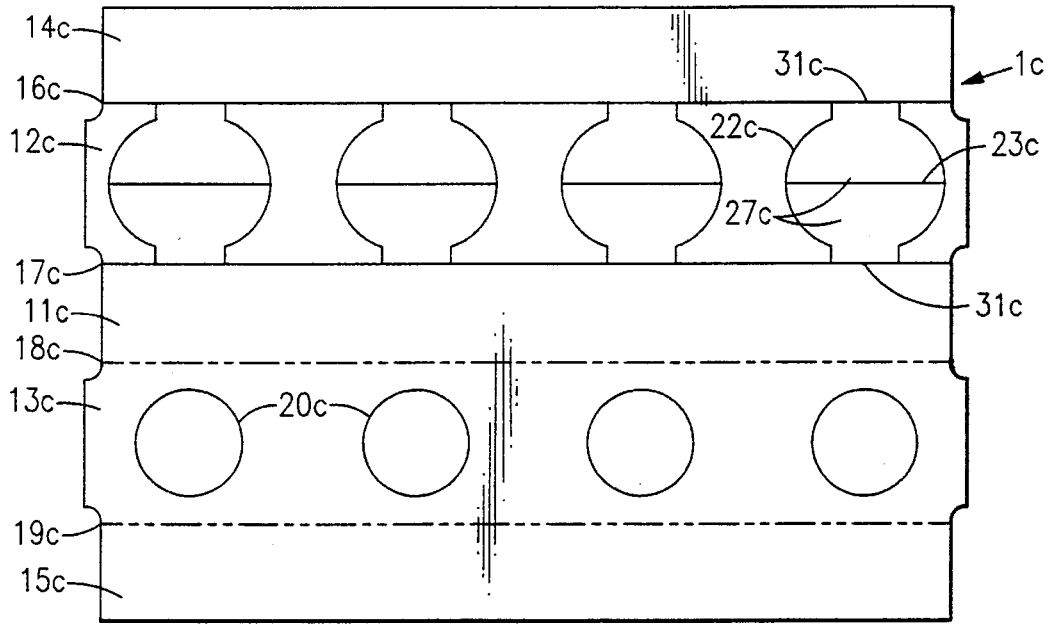
FIG. 6 is a top plan view of a seventh embodiment of the carrier, according to the present invention, in an unfolded orientation.
Figure 7:
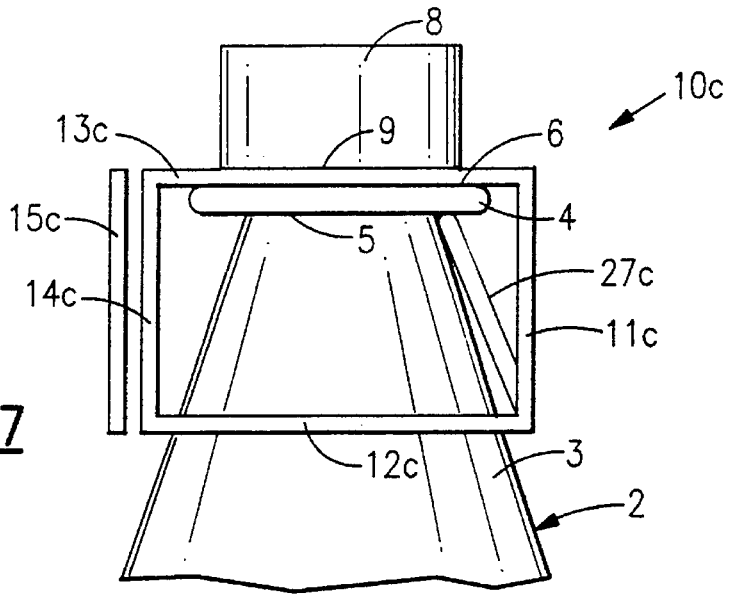
FIG. 7 is a side elevational view of the carrier of FIG. 6 in its folded in-use orientation.

A seventh embodiment of the invention is shown in FIG. 6 in which the five (5) longitudinal rectangular sections of sheet 1C are of different widths than the first embodiment since, in this embodiment, the first set of apertures 20C are formed in second intermediate section 13C and the cuts 22C and 23C, defining flaps 27C, are formed in first intermediate section 12C. Intermediate section 12C is somewhat wider than central section 11C as it is the section which initially engages the bottle 2 when the carrier 10C is placed on the bottle 2, and corresponds to central section 11 of the first embodiment. Intermediate section 13C is also wider than central section 11C, as it is the section which folds over the cap 8, and outer section 15C is of about the same width as central section 11C. Outer section 15C is somewhat wider than outer section 14C since section 15C is folded over section 14C along a side of the bottle 2, as shown in FIG. 7. The central section 11C and the two outer sections 14C and 15C are shorter than the two intermediate sections.

In this embodiment, the sides of outer sections 14C and 15C that will abut one another, e.g. a top surface of outer section 15C and a bottom surface of outer section 14C are preferably treated with a self-acting or pressure sensitive glue. When outer section 15C is folded over outer section 14C they will adhere to one another, but will not adhere to other surfaces which lack the self-acting glue.

Each cut 22C comprises two opposed pairs of short straight cuts extending perpendicular to grooves 16C and 17C towards the center of intermediate section 12C and a pair of semi-circular portions interconnecting each opposed pair of short straight cuts.

In this embodiment, as shown in FIG. 7, intermediate section 12C, with flaps 27C, is first placed over the bottle cap 8, folding flaps 27C about their bases 31C. Central section 11C is then folded about groove 17C upwardly toward cap 8 of bottle 2 so that second intermediate section 13C can be folded over the cap 8 of bottle 2, and the caps 8 project through the apertures 20C. First outer section 14C is then folded, about groove 16*c*, upwardly along the opposite side of bottle 2 and second outer section 15C is then folded downwardly over first outer section 14C and secured thereto by the self-acting glue.

Figure 8:
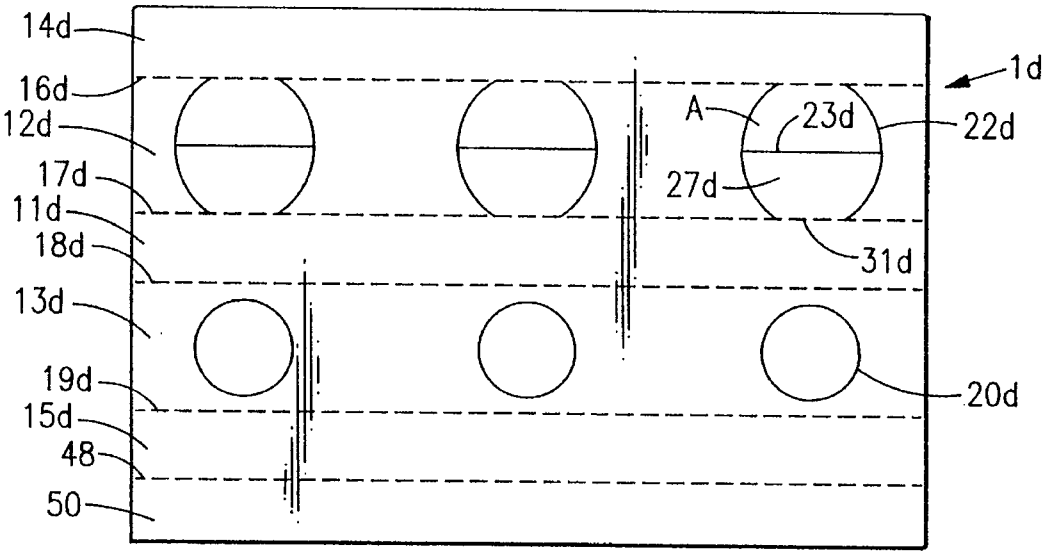
FIG. 8 is a top plan view of an eighth embodiment of the carrier, according to the present invention, in an unfolded orientation.

An eighth embodiment of the invention is shown in FIG. 8, which is similar to the seventh embodiment with respect to the location of flaps 27D in intermediate section 12D and apertures 20D in intermediate section 13D. This embodiment is different, however, in that longitudinal cuts 23 define one flap 27D and a semicircular shape aperture A. This embodiment includes a sixth longitudinal rectangular outermost tail section 50 connected to outer section 15D via groove 48 located between sections 15D and 50.

Figure 9:
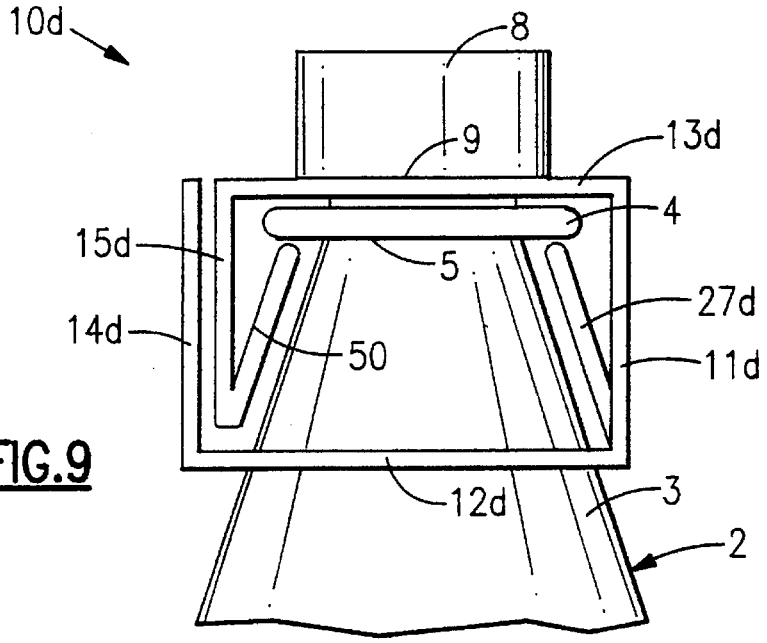
FIG. 9 is a side elevational view of the carrier of FIG. 8 in its folded in-use orientation.

As is shown in FIG. 9, in this embodiment the carrier 10D is folded about the bottle 2 similarly manner as that of the seventh embodiment. In particular, intermediate section 12D, with flaps 27D, is first placed over the bottle cap 8, folding flaps 27D about their bases 31D. Central section 11D is then folded about groove 17D upwardly toward cap 8 of bottle 2 so that second intermediate section 13D can be folded over the cap 8 of bottle 2, and the caps 8 project through the apertures 20D. Second outer section 15D is then folded downwardly along the opposite side of bottle 2 and tail section 50 is next folded inwardly such that it abuts the neck 3 with its free end being positioned adjacent and below flange 4. Lastly, first outer section 14D is then folded upwardly over outer section 15D and adhered to it with the self-acting glue that has been applied to both outer sections.

Figure 11:
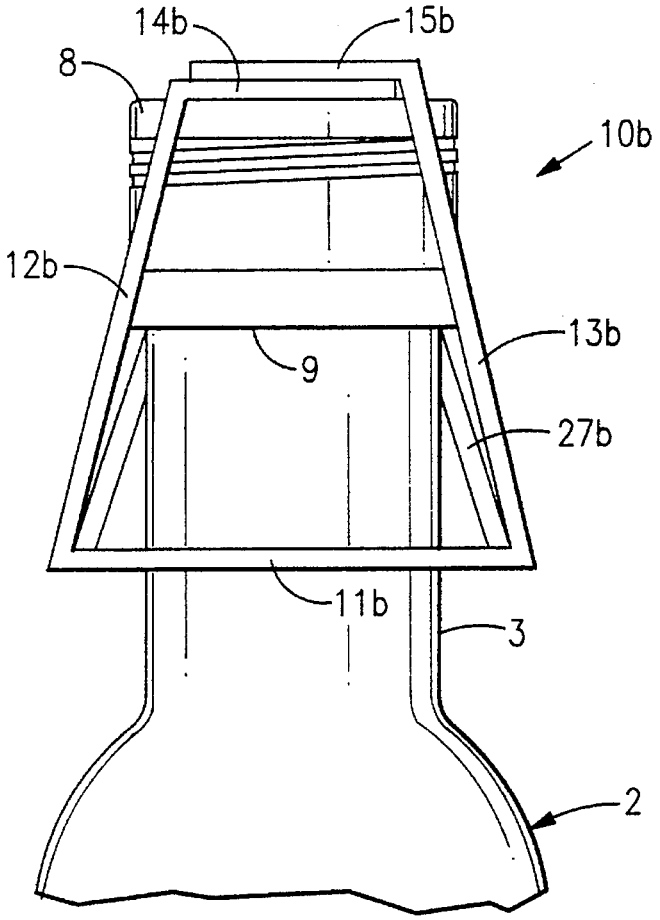
FIG. 11 is a side elevational view of the carrier of FIG. 10 in its folded in-use orientation.
Figure 10:
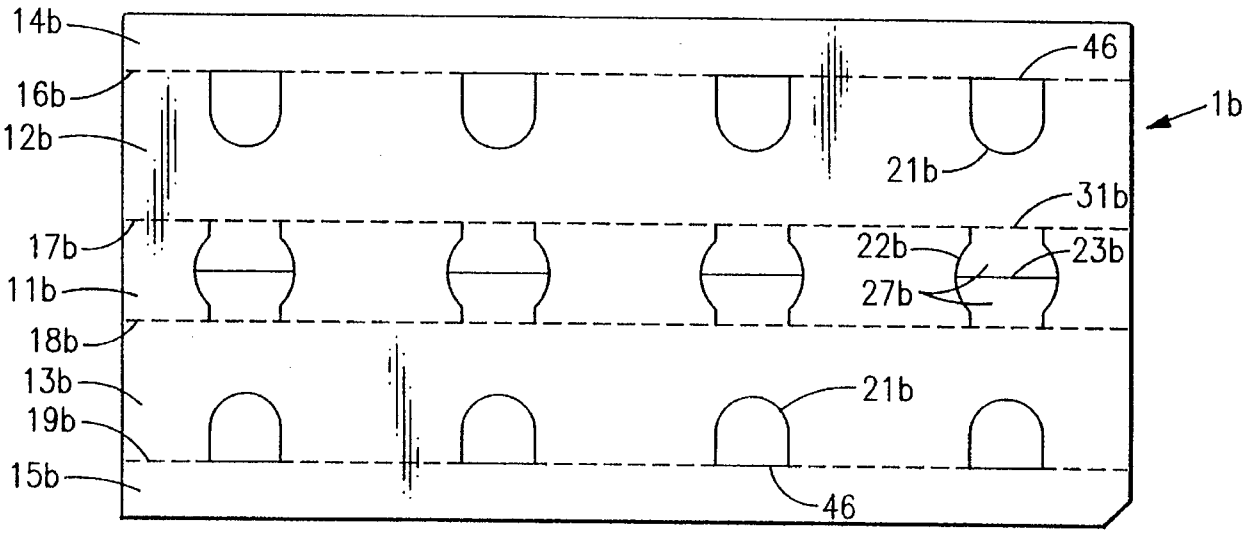
FIG. 10 is a top plan view of a ninth embodiment of the carrier, according to the present invention, in an unfolded orientation.

A ninth embodiment of the invention is shown in FIG. 10, where the five (5) longitudinal rectangular sections of sheet 1B are of different widths than the first embodiment since, in this embodiment, the outer sections 14B and 15B are folded over the top of the cap 8 of the bottle 2, and the intermediate sections 13B and 12B are folded along the sides of cap 8, with cap 8 only partially penetrating apertures 21B as shown in FIG. 11.

In this embodiment the carrier 10B, when in its folded orientation, has a substantially trapezoidal cross section. As a result of this, intermediate sections 12B and 13B, which form the sides of the carrier 10*b*, when in a folded position, are somewhat wider than central section 11B, which forms the bottom of the carrier 10B, and central section 11B is, in turn, somewhat wider than outer sections 14B and 15*b*, which overlap one another and form the top of the carrier 10*b*.

In this embodiment the sides of outer sections 14B and 15B that will abut one another, e.g. a top surface of second outer section 15B and a bottom surface of first outer section 14B, are preferably treated with a self-acting or pressure sensitive glue. When second outer section 15B is folded over first outer section 14B they will adhere to one another, but will not adhere to other surfaces which lack the self-acting glue.

Apertures 21B generally have the shape of an inverted U, extending from grooves 16B and 19B. These inverted U-shaped apertures 21B permit intermediate sections 12B and 13B to be folded along the sides of bottle 2 and encompass a portion of the cap 8. Outer sections 14B and 15B are then folded over the top of the cap 8 and overlap one another.

Each cut 22B comprises two opposed pairs of short straight cuts extending perpendicular to grooves 17B and 18B towards the center of section 11B and a pair of arcs interconnecting each opposed pair of short straight cuts. This embodiment is designed, in particular, for use with bottles 2 which do not have a flange, e.g. wine bottles. Flaps 27B are positioned below a lower most portion 9 of cap 8, as shown in FIG. 11.

It is to be appreciated that the number of apertures (20, 20A, 20B, 20C, 20D, 21, 21A, 21B, 21C, 21D) provided in the carrier (10, 10A 10B, 10C, 10D) is shown in the above Figures to be either two (2), three (3) or four (4), however, any desired number of apertures may be provided in the carrier depending upon the application at hand.

The invention is not limited to the shown and described embodiments but the features of these embodiments can be combined in a variety of ways and the invention can be modified within the scope of the inventive idea as set forth in the enclosed patent claims. In particular, it is possible to replace cuts 22, 22' with grooves and locate straight cuts 23, 23' between the latter, perpendicular to grooves 17 and 18.

Wherefore, I claim:

1. A carrier, for bottles having conically converging necks terminating with a cylindrical end and provided with a cap, comprising:

a substantially flat sheet having at least five longitudinal sections including a central section having two opposed longitudinal edges, one opposed longitudinal edge being connected to a first intermediate section and the other opposed longitudinal edge being connected to a second intermediate section, each intermediate section having an outer longitudinal edge, one outer longitudinal edge being connected to a first outer section and the other outer longitudinal edge being connected to a second outer section, each longitudinal edge defining a fold line about which the longitudinal sections are foldable;

an aperture provided in each outer section;

an opening cut provided in the central section to define a pair of foldable flaps, each foldable flap being foldable about a base line to provide a central aperture in the central section adapted to receive a conically converging neck of a bottle; and wherein the central aperture is larger than the apertures in the outer sections, and when the flat sheet is folded to form a sleeve having a hollow interior and overlapping outer sections, the opening cut and the apertures in the outer sections are superimposed over one another and adapted to receive a bottle such that the foldable flaps are influenced into the interior of the sleeve when a cap of the bottle penetrates the opening cut.

2. A carrier according to claim 1, wherein the opening cut comprises:

a pair of complementary shaped cuts provided between opposed longitudinal edges to define a flap area; and a longitudinal cut provided between the pair of complementary shaped cuts to divide the flap area into two symmetrical foldable flaps, said longitudinal cut being discontinued in a substantially small portion of the longitudinal cut to form a bridge which retains the foldable flaps in a planar orientation.

3. A carrier according to claim 2, wherein the pair of shaped cuts extend along at least one of a parabola-like pattern, a trapezoidal pattern, a triangular pattern and a straight line.

4. A carrier according to claim 1, wherein each said longitudinal edge comprises:

at least one of grooves, perforations, cuts and printed fold indications provided on an inwardly facing surface of said flat sheet when said flat sheet is folded.

5. A carrier according to claim 4, wherein each said longitudinal edge comprises:

a plurality of parallel grooves provided in a longitudinal direction; and perforated cuts provided between said grooves completely through a thickness of the flat sheet, said perforated cuts having a length at least equal to a length of an intermediate non-perforated area to minimize bending stress between adjacent longitudinal sections.

6. A carrier according to claim 5, wherein the perforated cuts in the longitudinal edges are staggered such that the perforated cuts in the two outermost longitudinal edges are provided according to a first distribution pattern and the perforated cuts in the two innermost longitudinal edges are provided according to a second distribution pattern.

7. A carrier according to claim 1, wherein, when the flat sheet is folded to form a sleeve having a hollow interior and overlapping outer sections, the first outer section is adjacent the interior of the sleeve and the second outer section is remote to the interior of the sleeve, and the apertures in the first outer section are larger than the apertures in the second outer section.

8. A carrier according to claim 1, wherein each foldable flap is provided with at least one groove to define a substantially triangular support flap, said support flap being foldable about the groove such that when the flat sheet is folded to form a sleeve, the foldable flaps are folded into the interior of the sleeve and the support flaps are folded along the groove, a free longitudinal edge of the support flap abuts an inwardly facing surface of the intermediate section.

9. A carrier according to claim 1, wherein each intermediate section comprises:

at least one pair of grooved base lines provided between adjacent longitudinal edges, each base line having a first end and a second end, the first end being connected to the opening cut;

a hypotenuse cut provided for each grooved base line connected to the first end of the grooved base line;

a side cut provided in the outer longitudinal edge for each grooved base line, connected to the second end of the grooved base line, and extended between the grooved base line and the hypotenuse cut to form a support flap which is foldable about the grooved base line.

10. A carrier according to claim 1, comprising:

an adhesive substance provided on a first surface of one outer section; and an adhesive substance provided on a mating surface of the other outer section.

11. A carrier according to claim 1, wherein said carrier is fabricated from a sheet of corrugated cardboard.

12. A carrier according to claim 1, wherein the flat sheet comprises a cut off corner at one end of the first outer section.

13. A carrier according to claim 12, wherein the flat sheet comprises a marked area at a corresponding corner of the second outer section such that the cut off corner and the marked area are provided at the same end of the flat sheet.

14. A carrier, for bottles having conically converging necks terminating with a cylindrical end and provided with a cap, comprising:

a substantially flat sheet having at least five longitudinal sections including a central section having two opposed longitudinal edges, one opposed longitudinal edge being connected to a first intermediate section and the other opposed longitudinal edge being connected to a second intermediate section, each intermediate section having an outer longitudinal edge, one outer longitudinal edge being connected to a first outer section and the other outer longitudinal edge being connected to a second outer section, each longitudinal edge defining a fold line about which the longitudinal sections are foldable;

at least one aperture being provided in each intermediate section;

at least one opening cut being provided in the central section to define a pair of foldable flaps, each foldable flap being foldable about a base line to provide a central aperture in the central section adapted to receive a conically converging neck of a bottle; and wherein, when the flat sheet is folded to form a sleeve having a hollow interior and overlapping outer sections, the opening cut and the aperture in each intermediate section are superimposed over one another and adapted to receive a bottle such that the foldable flaps are influenced into the interior of the sleeve when a cap of the bottle penetrates the opening cut.

15. A carrier according to claim 14, comprising:

an adhesive substance disposed upon at least one surface of one outer section for adhering said outer section to at least one other longitudinal section when the flat sheet is folded to form a sleeve having a hollow interior.

16. A carrier in combination with a bottle having a conically converging neck terminating with a cylindrical end having a flange and provided with a cap, comprising:

at least five longitudinal sections including a central section having two opposed longitudinal edges, one opposed longitudinal edge being connected to a first intermediate section and the other opposed longitudinal edge being connected to a second intermediate section, each intermediate section having an outer longitudinal edge, one outer longitudinal edge being connected to a first outer section and the other outer longitudinal edge being connected to a second outer section, each longitudinal edge defining a fold line, the longitudinal sections being folded about the fold lines to form a sleeve having a hollow interior and overlapping outer sections;

an aperture provided in each outer section;

an opening cut provided in the central section extending between adjacent longitudinal edges to define a flap area;

a longitudinal cut provided in the flap area to divide the flap area into two symmetrical foldable flaps; wherein the apertures in the outer sections and the flap area are superimposed over one another;

the bottle extends through the opening cut, the interior of the sleeve and the apertures in the outer sections;

during insertion of the bottle into the sleeve, the bottle urges a free end of each foldable flap into the interior of the sleeve as the bottle penetrates the opening cut until the free ends of the foldable flaps abut one of the flange and the overlapping outer sections; and the aperture in at least one outer section has a diameter such that the aperture elastically expands and constricts as at least one of the cap and the flange pass through the aperture to secure the bottle to the sleeve.

17. A carrier according to claim 16, wherein the aperture in the first outer section is surrounded by an annular groove having a diameter approximately equal to a diameter of the aperture in the second outer section, said annular groove to define an annular area having slits in a star-shaped fashion to define tabs such that when the cap penetrates the aperture in the first outer section, the tabs are urged to penetrate the aperture of the second outer section.

18. A carrier according to claim 16, wherein the apertures in both outer sections are smaller than the cap of the bottle such that the apertures elastically expand to allow the cap to pass through the apertures and elastically constrict around a neck of the bottle, once the cap has passed through the apertures, so that the elastic expansion and constriction of the apertures secure the bottle to the sleeve.

19. A carrier according to claim 16, wherein the foldable flaps have grooves to define substantially triangular support flaps having a free longitudinal edge that abuts an interior face of the intermediate sections.

20. A carrier according to claim 16, wherein the opening cuts extend along at least one of a parabola-like pattern, a trapezoidal pattern, a triangular pattern and a straight line.

* * * * *